United States Patent [19]

Baker

[11] 4,258,693

[45] Mar. 31, 1981

[54] WOOD BURNING STOVE

[76] Inventor: Arthur L. Baker, R.D. #1, Lewisberry, York County, Pa. 17339

[21] Appl. No.: 949,104

[22] Filed: Oct. 6, 1978

[51] Int. Cl.[3] ..... F24B 3/00; F24B 1/14

[52] U.S. Cl. ..... 126/67; 126/61; 126/63; 126/66

[58] Field of Search ..... 126/121, 67, 122, 61, 126/66, 63

[56] References Cited

U.S. PATENT DOCUMENTS

| | | | |
|---|---|---|---|
| 3,976,047 | 8/1976 | Breen et al. | 126/121 |
| 4,008,704 | 2/1977 | Petrie | 126/121 |
| 4,056,091 | 11/1977 | Moncrieff-Yeates | 126/121 |
| 4,091,794 | 5/1978 | Stites | 126/121 |
| 4,096,849 | 6/1978 | Moncrieff-Yeates | 126/121 |
| 4,150,658 | 4/1979 | Woods | 126/121 |

*Primary Examiner*—Samuel Scott
*Assistant Examiner*—Wesley S. Ratliff, Jr.
*Attorney, Agent, or Firm*—Charles J. Long

[57] ABSTRACT

An improved wood burning stove for providing heated air to a room or similar area includes an enclosed fire chamber, a hearth at the bottom of the fire chamber, draft inlet means at the front of the fire chamber and a flue at the rear of the fire chamber. Within the fire chamber is an enclosed air chamber having lower and upper portions; the lower portion communicates at the bottom of the stove with the ambient air and extends upwardly adjacent the rear wall of the fire chamber to a point below the flue, where it joins with the upper portion. The upper portion of the air chamber extends upwardly toward the front of the fire chamber at an acute angle with the horizontal, preferably between five and twenty-five degrees; at the forward end of the upper portion the air chamber communicates with one or more air pipes which extend to the front of the stove and there open to the ambient air. Ambient air is heated by passing it through the air chamber and air pipes after they have been heated by hot gases rising from a fire burning on the hearth; the hot gases contact the air pipes and the bottom surface of the air chamber's upper portion and, because their normal path of travel to the flue is altered by the positioning of the upper portion of the air chamber, contact the top surface of the air chamber's upper portion as well.

7 Claims, 6 Drawing Figures

WOOD BURNING STOVE

BACKGROUND OF THE INVENTION

1. Field of the Invention

This invention relates to wood burning stoves in which heat from burning wood or similar combustible material is used to heat the air in a room or the like. More particularly, the invention relates to such stoves in which hot gases from a fire heat the walls of passage ways through which ambient air passes, the ambient air thereby being heated, and in which the flow path of the hot gases increases their contact with the passage way walls to increase the amount of heat transferred to the ambient air. In some respects, this invention is an improvement over the invention described and claimed in my prior U.S. Patent application Ser. No. 855,932, now U.S. Pat. No. 4,127,100.

2. Description of the Prior Art

Wood burning stoves, so named because wood is the principal fuel used with them, have existed for many years. Most such stoves are of generally rectangular box-like shape and are fabricated from iron or steel plate. Common to virtually all wood burning stoves are a fire chamber or fire box in which the wood is placed for burning; draft inlet means to admit air to the fire chamber for combustion of the wood; and a flue or smoke stack to allow hot gases and fumes from the fire to escape from the fire chamber. In most stoves the fire chamber includes a hearth area lined with firebrick to support the burning wood. The wood is placed either directly on the brick or on a grate spaced above the brick. Additionally, some such stoves include controls on the draft inlet means which allow the amount of air entering the fire chamber to be decreased to a level which will just support combustion, thereby providing longer burning times for each load of wood burned.

Prior wood burning stoves have been designed in a variety of ways; most early designs of such stoves function as both cooking and heating stoves—that is, they include flat top surfaces for cooking and/or ovens for baking, and when in use also provides heat by radiation from the hot metal surfaces to the air of the rooms where they are located.

To augment the radiant heat from wood burning stoves, prior workers have devised several methods for providing a flow of heated air from the stoves. In one approach, one or more outer walls are spaced from the fire chamber walls to form an air passage way separate from the fire chamber, the passage way having a lower inlet and an upper outlet for ambient room air. Air in the passage way is heated by contact with the hot fire chamber walls and rises through the outlet, thereby drawing additional air into the passage way. As the additional air is heated, it, too, rises; a low volume flow of heated air is thus established to help warm the room. This approach, while useful, is inefficient; i.e., more of the heat from the burning wood escapes through the flue than is extracted for heating the room.

Another more recent approach to providing a flow of heated air to a room from a wood burning stove employs what is commonly known as a step stove, in which the stove top is divided into two horizontal portions, the rear portion being at a higher level than the front portion, with a short, nearly vertical section of plates joining the two. In this approach, air from the room flows, either by convection or through use of a blower, into a pipe mounted flush with the surface of the hearth floor and extending across the hearth at the front of the fire chamber. Two other pipes, one at each side of the hearth, communicate with the first pipe. Each of the other pipes extends from the front to the rear of the fire chamber, being positioned flush with the surface of the hearth floor; at the rear of the fire chamber each pipe makes a right-angle turn and extends vertically upward to a point near the top of the fire chamber, where it makes another right-angle turn and extends horizontally towards the front of the fire chamber, finally opening to the room at the short section joining the front and rear portions of the stove top. This stove has improved heating efficiency because the air pipes are within the fire chamber itself and thus extract more heat from the fire and hot gases rising from the fire than is extracted by the previously described passage way arrangement. Even here, however, a substantial amount of heat from the burning wood passes to the flue; that this is so is evidenced by the fact that the stove described can also heat water circulating through an optional coil which encircles the flue at the rear of the fire chamber.

Yet another approach of the prior art employs one or more horizontal or nearly horizontal pipes within the fire chamber and above the hearth. The pipes are heated by the hot gases rising from a fire on the hearth. Cool ambient air enters the hot pipes from an air collecting chamber outside the fire chamber at the rear of the stove and is heated as it passes through the pipes; the heated air leaves the pipes at the front of the stove, where it helps to heat the room. In all such stoves of which I am aware, the air flow is due exclusively to the air entering the pipes tending to rise as it is heated and thereby pulling additional cold air in from the rear of the pipe to establish a low volume air flow into the room. In some of these stoves nearly horizontal baffle plates extend partially across the fire chamber to direct hot gases from the fire into more intimate contact with the pipes. These stoves provide somewhat more efficient extraction of heat from the burning wood than the first above described stoves, but they are still basically inefficient; some increase in efficiency can be gained by use of a large number of small diameter pipes such as shown in U.S. Pat. No. 585,027, in which 14 small air pipes are used, but then the stove becomes complex and unduly expensive to fabricate.

From the foregoing, it is evident that wood burning stoves of the prior art, while useful to some extent in heating ambient room air, are not highly efficient in utilizing the heat from the burning wood for that purpose. Consequently, more wood is required to heat a given room with prior art stoves than would be necessary with better efficiency.

As set forth in my prior U.S. Patent application Ser. No. 844,932, now U.S. Pat. No. 4,127,100, I found that by positioning an air chamber and air pipes within the fire chamber of a wood burning stove, passing ambient air through such chamber and pipes and suitably baffling the flow of hot gases from the fire in the stove so that such gases contact substantially all of the surfaces of the chamber and pipe, high efficiency heating of ambient air can be achieved in a wood burning stove. Because of such efficiency, less wood is required to heat a room and savings in fuel costs can thereby be realized.

In my prior application I provided a wood burning stove for providing heated air to a room or similar area, comprising an enclosed fire chamber including a generally horizontal floor at the bottom thereof, a forward portion of the floor comprising a hearth for receiving wood to be burned; draft inlet means at the front of the fire chamber; a flue at the rear of the fire chamber and near the top thereof; an enclosed air chamber positioned between the rear of the hearth and the rear wall of the fire chamber and extending generally vertically from the bottom of the fire chamber to a point spaced from the top of the fire chamber, the air chamber having front and rear walls, a bottom and a top, the bottom of the air chamber communicating with the ambient air; at least one air pipe extending generally horizontally within and along the top portion of the fire chamber, one end of the air pipe communicating with the interior of the air chamber at the top of the air chamber and the other end opening to the ambient air at the front of the stove; and a generally vertical baffle plate positioned between and spaced from the air chamber and the rear wall of the fire chamber and extending the full width of the interior of the fire chamber, the baffle plate being joined at its top edge to the top of the fire chamber, the bottom edge of the baffle plate being spaced from the bottom of the fire chamber, whereby the flow of hot gases rising from a fire in the fire chamber would be such that the gases contact the surface of the air pipe and both the front and rear walls of the air chamber.

The stove of my prior application functions quite well; as indicated in such application, with such stove I can heat a room for extended periods of time, as much as 24 hours, using a single log, and with proper adjustment of the draft inlet complete combustion of the logs can be achieved, i.e., very few ashes accumulate on the hearth. Also, because of the thorough contact of hot gases with the walls of the air pipes and air chamber, a very high proportion of the heat is extracted from such gases and transferred to the ambient air so that the gases escaping through the flue are at a relatively low temperature; thus, with my stove the danger of burns from a hot flue or flue pipe is less than with conventional stoves of the prior art.

I found, however, that my vertical air chamber—separate vertical baffle plate stove was somewhat complex to fabricate in smaller sizes and the separate vertical baffle plate added undesirable weight to large double—door models. I concluded that if the air chamber and baffle plate could be combined into one unit, the resulting stove would retain all the desirable features of my prior stove and at the same time overcome the just discussed difficulties encountered with that stove.

SUMMARY OF THE INVENTION

I have found that by positioning an air chamber within the fire chamber of a wood burning stove so that at least one wall of the air chamber is in sealing engagement with both sides and the rear wall of the fire chamber and extends upwardly towards the front of the fire chamber at an acute angle with the horizontal from a point on the rear wall below the flue to a forward point spaced from both the top and front wall of the fire chamber, the air chamber itself acts as a baffle to alter the normal path of hot gases rising from a fire in the fire chamber, whereby such gases will contact all exterior surfaces of the air chamber, as well as the surface of an air pipe extending from the air chamber to the front of the stove, and thereby provide improved efficiency of heating the air passing through the air chamber and pipes.

In accordance with the invention, I provide an improved stove for providing heated air to a room or similar area, of the type comprising an enclosed fire chamber having front and rear walls, opposite side walls, a generally horizontal bottom and a top of which a major portion is generally horizontal, draft inlet means at the front of the fire chamber, a hearth at the bottom of the fire chamber for receiving wood or similar combustible material to be burned and an exhaust flue having an opening of pre-determined cross-sectional area at the rear of the fire chamber and near the top thereof, wherein the improvement comprises: an enclosed air chamber within the fire chamber and having a lower portion and an upper portion; the lower portion of the air chamber communicating with the ambient air at the bottom of the stove and extending upwardly therefrom adjacent the rear wall of the fire chamber to a point below the flue, where it communicates with the upper portion; the upper portion of the air chamber having upper and lower walls, at least the upper wall being in sealing engagement with the opposite side walls and rear wall of the fire chamber and extending upwardly toward the front of the fire chamber at an acute angle with the horizontal to a point spaced from both the top and front wall of the fire chamber, the minimum cross-sectional area of the opening defined by the upper wall and the top and opposite side walls of the fire chamber being at least about equal to the cross-sectional area of the flue opening; and at least one air pipe extending generally horizontally within and near the top of the fire chamber, one end of the pipe communicating with the upper end of the air chamber and the other end opening to the ambient air at the front of the stove, whereby the flow of hot gases rising from a fire in the fire chamber will be such that the gases contact the surface of the air pipe and both the lower and upper walls of the upper portion of the air chamber.

Preferably, the lower portion of the air chamber communicates with the ambient air through a blower, whereby air can be blown through the air chamber and air pipe.

In a preferred embodiment, a plurality of air pipes is provided, one end of each air pipe communicating with the air chamber and the other end of each opening to the ambient air at the front of the stove.

In a further preferred embodiment, the air chamber includes interior deflecting means so constructed and arranged as to cause air blown into the chamber by the blower to flow to substantially all portions of the interior of the air chamber and to enter each of the air pipes at substantially the same flow rate.

Generally, I prefer that the upper portion of the air chamber be substantially rectangular in cross-section.

For certain stoves, such as those having extra widths, I prefer that the lower portion of the air chamber be of substantially rectangular cross-section and comprise a forward wall which is in sealing engagement with the opposite sides and the bottom of the fire chamber.

For best operation, the upper wall of the upper portion of the air chamber should form an angle of between five and twenty-five degrees with the horizontal.

Other details, objects and advantages of the invention will become apparent as the following description of a present preferred embodiment thereof proceeds.

BRIEF DESCRIPTION OF THE DRAWINGS

In the accompanying drawings I have shown a present preferred embodiment of the invention in which:

FIG. 3 is a view taken along the lines 3—3 of FIG. 2 showing the rectangular cross-section of one embodiment of the upper portion of the air chamber;

DESCRIPTION OF THE PREFERRED EMBODIMENT

I prefer the stove of my invention to be a step-stove, as described hereinabove, although the concepts involved are equally applicable to stoves of other general design, e.g. flat top stoves.

Figure 1:
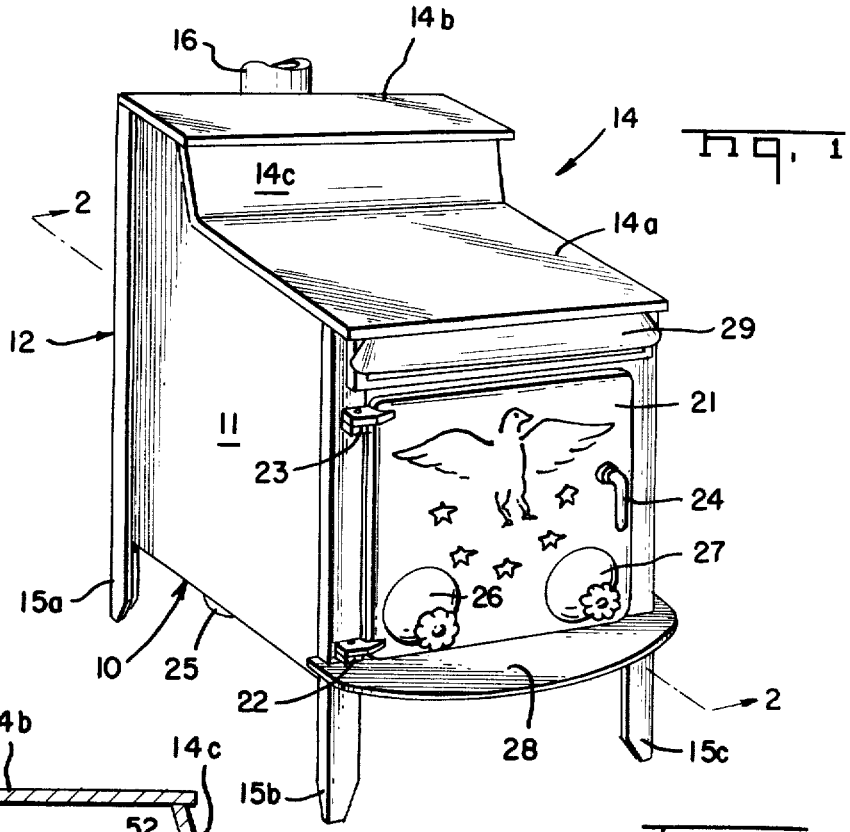
FIG. 1 is a perspective view of a stove embodying the principals of my invention.
Figure 2:
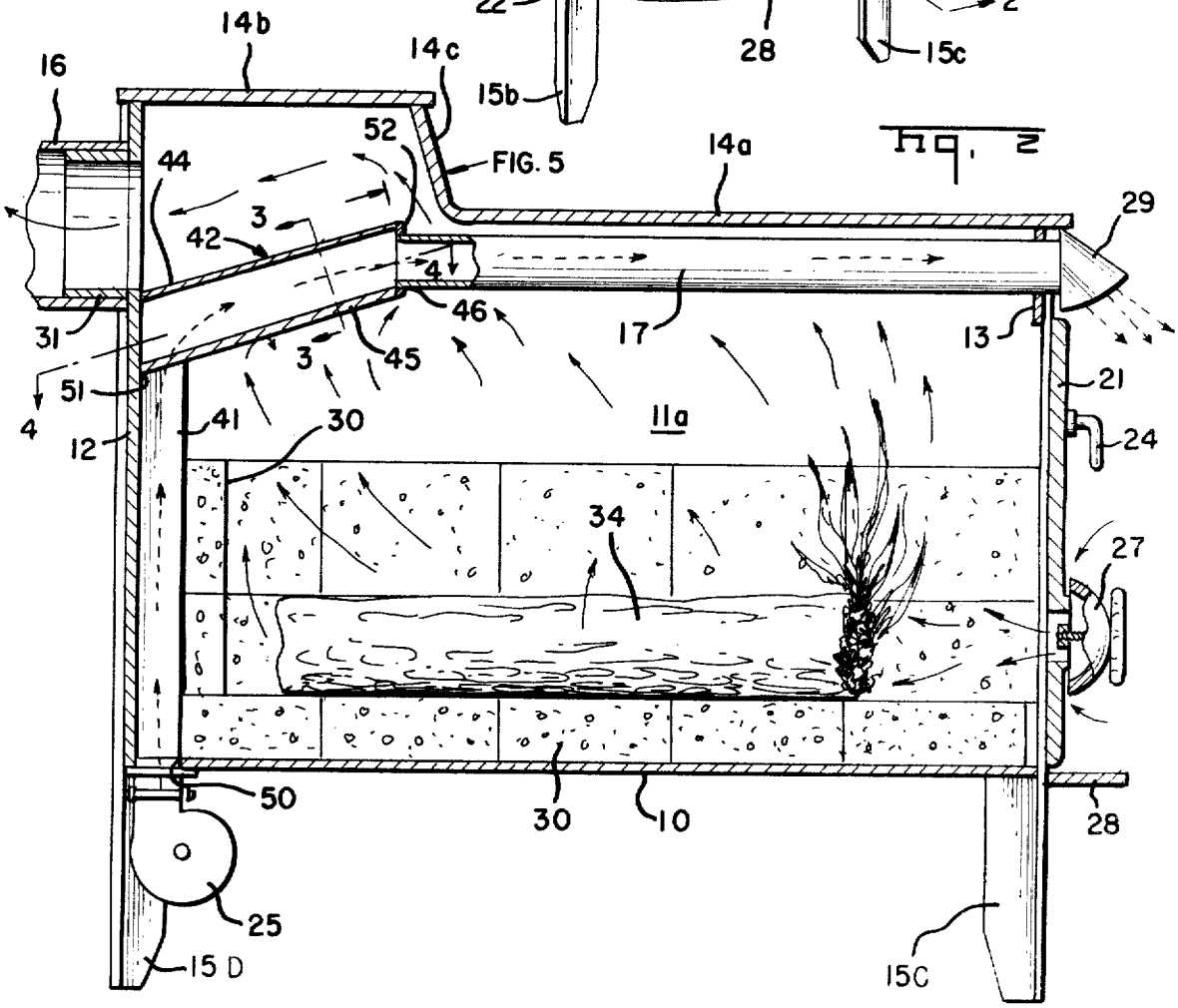
FIG. 2 is a cross-sectional view taken along the lines 2—2 of FIG. 1, illustrating the basic operation of the improved stove of my invention, including paths of movement of the ambient air and the gases generated by a fire within the fire chamber.

Referring first to FIGS. 1 and 2, there is shown in perspective and cross-section a step-stove of my invention. The stove includes a generally horizontal rectangular bottom plate 10 to which are joined side plates 11 and 11*a*, back plate 12 and front plate 13. I may use for these parts ¼ inch thick steel plate, although other suitable materials can be used by those skilled in the art. The front, back and side plates support and are joined to the stove top designated generally as 14. The top, which may be fabricated from 5/16 inch thick steel plate for example, consists of a large generally horizontal forward section 14*a*, a smaller generally horizontal rear section 14*b* at a higher level than the forward section, and a short, nearly vertical section 14*c* joining the two; as is evident, a major portion of the top is generally horizontal. The complete assembly of plates, along with the stove door described hereinbelow, defines an enclosed fire chamber having front and rear walls, opposite side walls, a generally horizontal bottom and a top of which a major portion is generally horizontal. In order to prevent leakage of air or gas to or from the fire chamber, I prefer to join all plates by welding.

Four angle iron legs 15*a*, 15*b*, 15*c* and 15*d*, one at each corner of the stove, support the stove above the ground or floor at a sufficient height to accommodate blower 25, partially visible in FIG. 1, which is mounted on the bottom plate 10. A flue pipe 16 allows for the escape of smoke and gases from a fire burning in the stove. Holes cut into the front plate 13 accommodate air pipes 17, 18, 19 and 20, described more fully hereinbelow, and a door 21. The door 21 is suspended from hinges 22 and 23 which are attached to leg 15*b*; a latch 24 allows the door to be opened for loading the fire chamber with wood, starting the fire, and the like; when a fire is burning in the fire chamber, the latch holds the door tightly closed so as to minimize undesired incursion of air to the fire chamber. Adjustable draft inlet means 26 and 27 are provided in the door 21; such draft inlet means, described more fully in my prior above referred to application, provide control of the amount of air admitted to the fire chamber for combustion, so that the burn time for each log can be maximized by allowing into the fire chamber only the minimum air necessary to sustain combustion.

Just below the door at the front of the stove is an ash catcher 28, the function of which is to prevent hot ashes or spark from the fire from landing on the floor when the door is open. Also on the front of the stove a decorative hood 29 is mounted on the front plate 13 so as to direct hot air emanating from the ends of the air pipes downwardly toward the floor of the room or the like being heated.

Turning to FIG. 2, the floor 10 of the fire chamber comprises a hearth for receiving wood or similar combustible material to be burned. In this embodiment, the hearth and the lower portions of the side and rear walls are lined with fire brick 30 to minimize the effects of heat on the plate from which the stove is fabricated, but fire brick is not required in the practice of the invention. At the rear of the fire chamber and near the top thereof is a flue 31 through which smoke and gases from fire in the fire chamber can escape. The flue opening, which is normally circular, has a predetermined cross-sectional area which is generally related to the size of the stove; for example, in a stove of typical size I may conveniently use a flue having a circular opening six inches in diameter, the cross-sectional area of which is approximately 28.3 square inches. The flue 31 is connected to the flue pipe 16 which conducts smoke and gases to the outside of the room in which the stove is located.

Within the fire chamber is an enclosed air chamber having a lower portion 41 and an upper portion 42. The lower portion 41 communicates with the ambient air through a hole 50 in bottom plate 10 and through an electric blower 25 which is attached to bottom plate 10 with its outlet tube aligned with hole 50 so as to blow air through the air chamber and air pipes, described more fully hereinbelow, at a predetermined rate. In the embodiment shown in FIGS. 2, 3 and 4, the lower portion of the air chamber is essentially a steel tube of rectangular cross-section which extends upwardly from the bottom of the stove adjacent the rear wall of the fire chamber to a point 51 below the flue where it communicates with the upper portion 42, as is evident from FIG. 4. I prefer a rectangular cross-section in this embodiment principally because it allows the rear wall of the fire chamber to serve also as the rear wall of the air chamber's lower portion and thereby effects savings in material and weight. In such embodiment, the lower portion of the air chamber consists of two side plates 41*a* and 41*b* joined at their front edges to a front plate 41*c* and at their back edges to the rear wall 12 of the fire chamber. I utilize welding to form the joints in both this portion and the upper portion of the air chamber, in order to prevent the entry of gases or smoke from the fire into the air chamber.

The upper portion 42 of the air chamber has upper and lower walls, 44 and 45 respectively, and a front wall 46. In the embodiment shown, both the upper and lower walls consist of flat steel plates which extend laterally the full width of the interior of the fire chamber; at their opposite lateral edges, the plates are welded to the opposite side walls 11 and 11*a* of the fire chamber, and at their rear edges they are welded to the rear wall 12 of the fire chamber. As with the lower portion of the air chamber, this design of the upper portion allows the fire chamber walls to serve also as side and rear walls of the air chamber's upper portion, thus saving both material and weight. It will be appreciated that in the embodiment shown in FIGS. 2, 3 and 4 both the upper and lower walls of the air chamber's upper portion are in sealing engagement with the opposite side walls and rear wall of the fire chamber; however, the stove will function equally well if only the upper wall is in such engagement. The object of having at least the upper wall in sealing engagement with the opposite side walls and rear wall of the fire chamber is to alter the path of travel of the hot gases rising from a fire burning on the hearth, as is described in more detail hereinbelow. Further, it will be appreciated that in the embodiment shown, the upper portion of the air chamber is substantially rectangular in cross-section as shown in FIG. 3.

Figure 5:
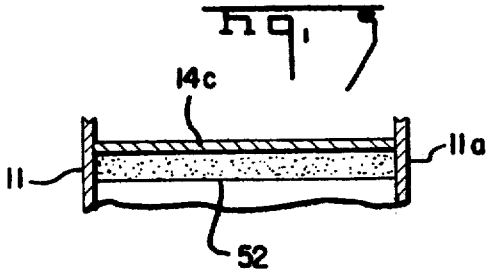
FIG. 5 is a fragmentary view illustrating the minimum cross-sectional area of the opening defined by the upper wall of the upper portion of the air chamber and the top and opposite side walls of the fire chamber.

The upper wall 44 of the upper portion 42 of the air chamber extends upwardly toward the front of the fire chamber at an acute angle with the horizontal; preferably this angle is between 5 and 25 degrees, and in the embodiment shown in FIG. 2 it is 15 degrees. The forward edge 52 of the upper wall 44 terminates at a point spaced from both the top and the front wall of the fire chamber. The minimum cross-sectional area of the opening defined by the air chamber's upper wall and the top and opposite side walls of the fire chamber is shown in FIG. 5; in the embodiment shown in the figures, this area is bounded by the front edge 52 of the air chamber's upper wall, the two side walls 11 and 11*a* of the fire chamber, and the short, nearly vertical section 14*c* of the top, but with different lengths or slopes of the air chamber's upper wall it could be bounded by one of the horizontal portions 14*a*, 14*b* of the top rather than the nearly vertical portion 14*c*. I have found that for best results, more particularly to allow adequate flow of smoke and hot gases from the fire chamber out through the flue, the area shown in FIG. 5 should be at least about equal to the cross-sectional area of the flue opening; for example, with a circular flue of six inches diameter and a cross-sectional area of about 28.3 square inches, I may so position the air chamber's upper wall that the area shown in FIG. 5 has dimensions of about 1¾ inches by 18 inches, which gives a cross-sectional area of about 31.5 square inches.

Figure 4:
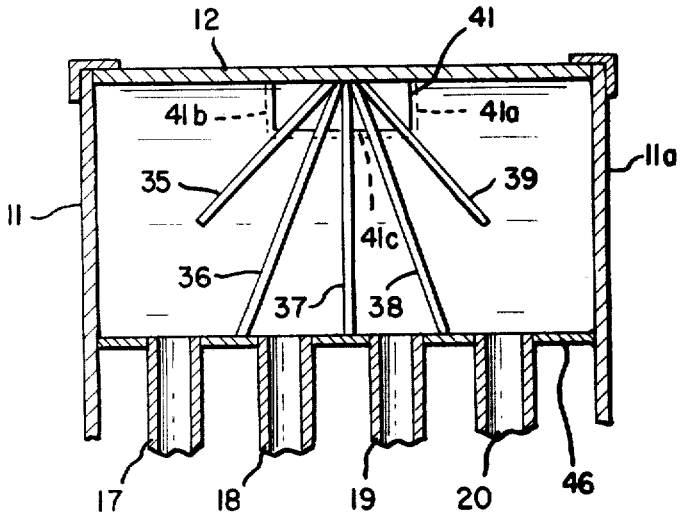
FIG. 4 is a view taken along the lines 4—4 of FIG. 2 showing the position of the interior deflecting means in the upper portion of the air chamber and their relationship to the air pipes.
Figure 7:
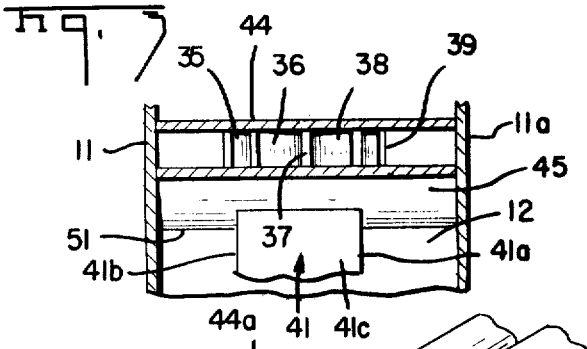

As is shown in FIG. 2, and more clearly in FIG. 4, air pipes 17, 18, 19 and 20 communicate at one end with the interior of the air chamber at its upper end, which in the embodiment shown is at its forward wall 46; the air pipes extend from the air chamber generally horizontally within and near the top of the fire chamber to the front of the stove, where they open to the ambient air.

In use, my stove functions in the following way, viewing FIG. 2: a log 34 is placed on the hearth and ignited by any suitable means, after which door 21 is closed. Draft inlets 26 and 27 are then opened a desired amount to allow air to enter the fire chamber to maintain combustion of the log. The path of air and gases through the fire chamber is indicated in FIG. 2 by solid arrows. As the log is consumed by the flames hot gases and smoke rise from the fire; the initial direction of flow of such hot gases and smoke is upward and toward the rear of the fire chamber where flue 31 is located. As they rise and flow toward the rear, the hot gases contact air pipes 17, 18, 19 and 20, the front wall of the air chamber's lower portion 41 and the lower wall 45 of the air chamber's upper portion, thus heating the metal from which such pipes and chamber walls are fabricated. The upper portion of the air chamber presents a barrier to the hot gases and smoke which restricts their flow to the opening shown in FIG. 5; because of the slope of the upper portion of the air chamber, after the hot gases and smoke pass through such opening they must then travel in a slightly downward direction to reach the flue 31, and in so doing they also heat the upper wall 44 of the air chamber's upper portion.

Blower 25 forces ambient room air, illustrated by broken arrows, up through the air chamber, through air pipes 17, 18, 19 and 20 and back into the room at the front of the stove. The ambient air packs up heat from the heated walls of the air chamber and air pipes and thereby the room in which the stove is located is provided with a constant flow of heated air.

Although use of a blower is not absolutely necessary with my improved stove, since heated air would flow by convection through the air chamber and air pipes, I prefer using a blower to increase the air flow because more heat is thereby extracted from the walls of the air chamber and air pipes and consequently from the hot gases rising from the fire. I may additionally provide a rheostat in the blower circuitry so that the amount of heated air flowing into the room can be regulated as desired.

In order to maximize the amount of heat picked up by the ambient air flowing through the air chamber, it is preferable that such air contact as much of the interior wall surface of the air chamber as possible and that the air flow into the air pipes be uniformly divided between the pipes. To accomplish these purposes, I provide interior deflecting means within the upper portion 42 of the air chamber. Such means are in the form of vanes 35, 36, 37, 38 and 39 in the embodiment illustrated in FIG. 4. Each vane is formed from a metal plate having a width equal to the interior height of the upper portion of the air chamber. Vanes 36, 37 and 38 are all substantially equal in length; the forward ends of the vanes are welded to the front wall 46 of the air chamber at points approximately mid-way between the ends of air pipes 17 and 18, 18 and 19, and 19 and 20, respectively, and the vanes are positioned so that they converge at the rear wall of the air chamber's upper portion and thereby divide into four approximately equal sections the area of the lower portion of the air chamber through which air flows into the upper portion thereof. Vanes 36, 37 and 38 therefore serve to split the column of air entering the upper portion of the air chamber into four roughly equal segments, and vanes 35 and 39 serve to further divide the two outer portions of the air flow so that air entering the upper portion of the air chamber is caused to flow to substantially all portions of the interior thereof and thereby pick up maximum heat from the air chamber walls.

Figure 6:
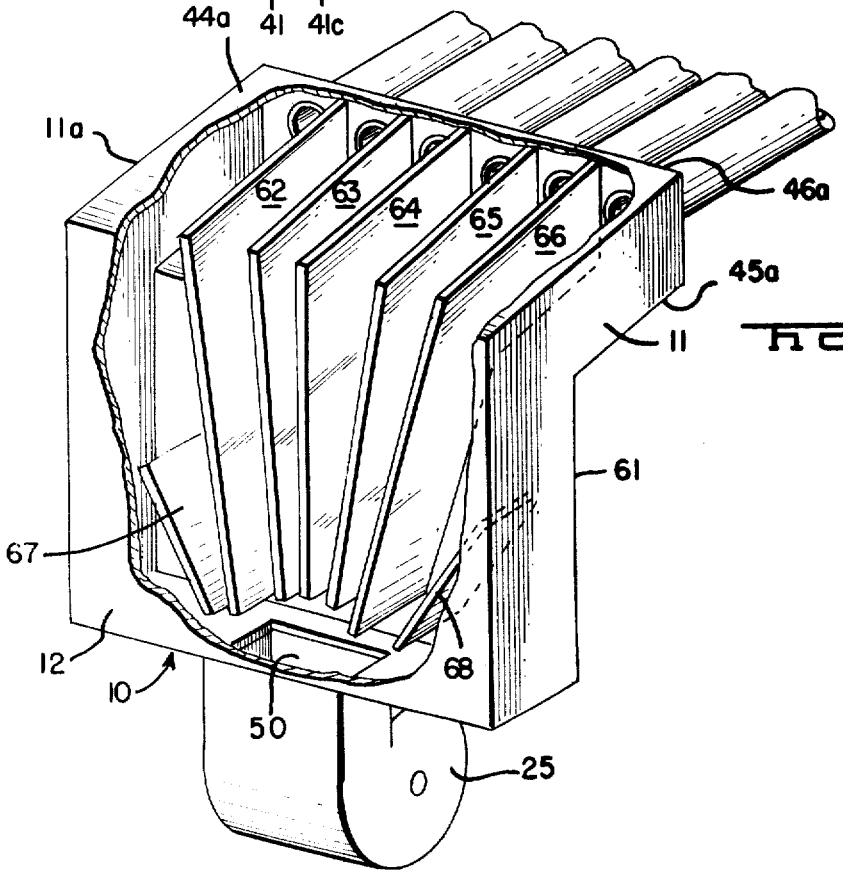
FIG. 6 is a three-dimensional view, with parts broken away, of an alternative construction of the air chamber and interior deflecting means.

Turning now to FIG. 6, there is shown an alternate design of air chamber and deflecting means which may be used for wider stoves of my invention. In this design, the air chamber's upper portion is substantially identical to the upper portion shown in FIG. 2, but the lower portion, while still of rectangular cross-section, comprises a forward wall which is in sealing engagement with the opposite sides and the bottom of the fire chamber. As illustrated in FIG. 6, such lower portion utilizes the rear wall, side walls and bottom of the fire chamber as its rear wall, side walls and bottom respectively, and its front wall is formed from a piece of plate 61 joined at its sides and bottom to the side walls and bottom of the fire chamber and at its top edge to the bottom wall of the upper portion of the air chamber, designated 45a. For ease in fabrication, I may use a single piece of plate for both the forward wall 61 of the lower portion and the bottom wall 45a of the upper portion, merely forming an angle in the plate at the point where the two portions meet. In FIG. 6, therefore, both the upper and lower portions of the air chamber extend the full width of the fire chamber and are of substantially rectangular cross-section, which presents a considerably greater air chamber wall area to the heat from the fire than the air chamber illustrated in FIGS. 2 through 4. Because of its typical use in wider stoves, the air chamber of FIG. 6 is shown communicating with six air pipes at the forward wall 46a of its upper portion, although more or fewer air pipes may be used as desired. At the bottom of its lower portion, the air chamber of FIG. 6 communicates with the ambient air through hole 50 and blower 25, the same as the embodiment of FIG. 2 does.

The interior deflecting means of the air chamber of FIG. 6 function in precisely the same way as the means shown in FIG. 4, but they are oriented and fabricated somewhat differently because of the extra width of the air chamber's lower portion. More particularly, such interior deflecting means comprise vanes 62 through 68, each formed from metal plates having a width equal to the interior distance between front and back walls of the air chamber's lower portion or upper and lower walls of the upper portion, as the case may be. Vanes 62 through 66 are joined to the forward wall 46a of the air chamber's upper portion at points approximately mid-way between the ends of the first and second, second and third, third and fourth, fourth and fifth, and fifth and sixth air pipes respectively. From the front wall 46a the vanes extend to the rear of the upper portion of the air chamber in a direction parallel to the side walls thereof; from the rear of the upper portion of the air chamber, which in FIG. 6 is also the top of the lower portion of the air chamber, the vanes extend downwardly through the lower portion to a point just above hole 50, and they are positioned so that their bottom ends divide into six approximately equal sections the area of that hole. Thus vanes 62 through 66 serve to split the column of air entering the air chamber into six equal segments; vanes 67 and 68 serve to further divide the two outer portions of the air flow so that air entering the chamber is caused to flow to substantially all portions of the interior thereof and thereby pick up maximum heat from the air chamber walls.

I have found that my improved stove functions as well as or better than the stove described and claimed in my above mentioned prior application; moreover, by combining the air chamber and baffle plate into one unit, my improved stove results in greater ease of fabrication and in savings in both material and weight as compared to my prior stove.

While I have shown and described a certain present preferred embodiment of the invention, it is to be distinctly understood that the invention is not limited thereto, but may be otherwise variously embodied within the scope of the following claims:

I claim:

1. An improved stove for providing heated air to a room or similar area, of the type comprising an enclosed fire chamber having front and rear walls, opposite side walls, a generally horizontal bottom and a top of which a major portion is generally horizontal, draft inlet means at the front of the fire chamber, a hearth at the bottom of the fire chamber for receiving wood or similar combustible material to be burned, and a flue having an opening of predetermined cross-sectional area at the rear of the fire chamber and near the top thereof, wherein the improvement comprises:

an enclosed air chamber within the fire chamber and having a lower portion and an upper portion;

the lower portion of the air chamber communicating with the ambient air at the bottom of the stove and extending upwardly therefrom adjacent the rear wall of the fire chamber to a point below the flue, where it communicates with the upper portion;

the upper portion of the air chamber having upper and lower walls, at least the upper wall being in sealing engagement with the opposite side walls and rear wall of the fire chamber and extending upwardly toward the front of the fire chamber at an acute angle with the horizontal to a point spaced from both the top and the front wall of the fire chamber, the minimum cross-sectional area of the opening defined by the upper wall and the top and opposite side walls of the fire chamber being at least about equal to the cross-sectional area of the flue opening;

the forward end of the upper wall of the air chamber's upper portion being substantially vertically above the lowermost portion of the flue opening;

at least one air pipe extending generally horizontally within and near the top of the fire chamber, one end of the pipe communicating with the upper end of the air chamber and the other end opening to the ambient air at the front of the stove, whereby the flow of hot gases rising from a fire in the fire chamber will be such that the gases contact the surface of the air pipe and both the lower and the upper walls of the upper portion of the air chamber.

2. A stove as claimed in claim 1, in which a plurality of air pipes is provided, one end of each air pipe communicating with the air chamber and the other end of each opening to the ambient air at the front of the stove.

3. A stove as claimed in claim 2, in which the lower portion of the air chamber communicates with the ambient air through a blower, whereby air can be blown through the air chamber and air pipes.

4. A stove as claimed in claim 3 in which the air chamber includes interior deflecting means for causing air blown into the chamber by the blower to flow to substantially all portions of the interior of the air chamber and to enter each of the air pipes at substantially the same flow rate.

5. A stove as claimed in claim 4, in which the upper portion of the air chamber is substantially rectangular in cross-section.

6. A stove as claimed in claim 5, in which the lower portion of the air chamber is of substantially rectangular cross-section and comprises a forward wall which is in sealing engagement with the opposite side walls and the bottom of the fire chamber.

7. A stove as claimed in claim 5 or 6, in which the upper wall of the upper portion of the air chamber forms and angle of between five and twenty-five degrees with the horizontal.

* * * * *